United States Patent [19]

Aario

[11] Patent Number: 4,595,150

[45] Date of Patent: Jun. 17, 1986

[54] BLOCKING SLAB FOR PULP GRINDER

[75] Inventor: Matti Aario, Pirkkala, Finland

[73] Assignee: Oy Tampella AB, Tampere, Finland

[21] Appl. No.: 585,105

[22] Filed: Mar. 1, 1984

[30] Foreign Application Priority Data

Mar. 22, 1983 [FI] Finland ..... 830962

[51] Int. Cl.[4] ..... B02C 19/12

[52] U.S. Cl. ..... 241/282; 241/28

[58] Field of Search ..... 241/21, 28, 280, 282, 241/277, 281, 151

[56] References Cited

U.S. PATENT DOCUMENTS 3,627,213 12/1971 Thumm .

3,734,419 5/1973 Cryderman ..... 241/282

FOREIGN PATENT DOCUMENTS 2804334 9/1979 Fed. Rep. of Germany .

53140 10/1977 Finland .

*Primary Examiner*—Mark Rosenbaum

[57] ABSTRACT

A blocking slab for a pulp grinder, which blocking slab comprises a striplike frame to be mounted between a wall of a grinding chamber in the grinder and a grindstone, said frame being parallel to the axle of the grindstone. In order to prevent splinters and chips from getting out of the grinding chamber, the frame is provided with a longitudinal retaining edge facing to the peripherical surface of the grindstone. The retaining edge has at least one longitudinal recess, which is limited by two longitudinal retaining ribs, to prevent splinters and chips from getting out of the gap between the grindstone and the blocking slab.

4 Claims, 5 Drawing Figures

BLOCKING SLAB FOR PULP GRINDER

Figure 1:
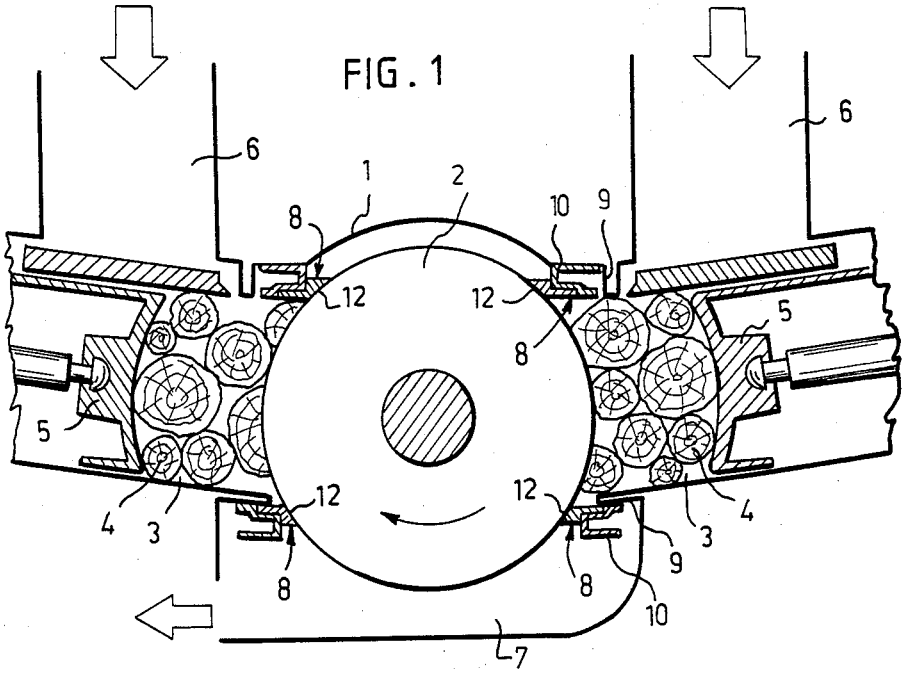

This invention relates to a pulp grinder comprising a grindstone rotably mounted in a grinding chamber, means for pressing wood to be ground against the grindstone, and a blocking slab intended to prevent escape of unground splinters and chips from the between the grindstone and a wall of the grinding chamber.

When grinding wood in a grinder, the wood batch is pressed with the aid of a brake shoe in the grinding chamber against the grindstone with a force that can obtain a pressure of up to 89N/cm$^2$ (10 kp/cm$^2$). Because of this, the wood to be ground is inclined to get out through gaps between the walls of the grinding chamber and the grindstone as splinters and chips and not be ground into fibres, which is the object of the grinding. Furthermore the splinters and chips can block the grinder and later on the piping.

To prevent the chips and splinters from getting out of the grinding chambers, it is known from, for example, the Finnish Published Specification No. 53 140 (corresponding to U.S. Pat. No. 3,627,213) and the German Patent Application No. 2 804 334 to furnish each grinding chamber with two blocking slabs which close the gaps between the grindstone and the walls of the grinding chamber. The blocking slabs are relatively narrow strips, which are secured on one side to a movable carrier supported by the frame of the grinder, so that, as the stone and the blocking slab are worn, the blocking slab can be adjusted from time to time as closely to the stone as possible. The retaining edge of the blocking slab that is turned against the grindstone has a smooth surface.

The disadvantage of these known constructions is that splinters and chips still can slip relatively easily through the gaps between the grindstone and the blocking slabs during grinding, mostly because of the narrowness of the retaining edge. This tendency is hightened by the fact that the narrow blocking slabs, which are secured only on one level to the carrier, can, when the load pressure is increased, bend and enlarge the gap between the grindstone and the blocking slab and thus let through an increasing amount of splinters and chips.

The object of this invention is to provide a blocking slab that more efficiently prevents splinters and chips from escaping through the gap between the grindstone and the blocking slab. This object is achieved by the blocking slab according to the invention, which is characterized in that the retaining edge is provided with at least one longitudinal recess limited by two longitudinal retaining ribs.

The invention is based on the idea that, by forming on the retaining edge of the blocking slab at least one longitudinal recess, an enlargement of the gap between the grindstone and the blocking slab is attained, which enlargement is crosswise as regards the rotation direction of the grindstone. Thus the splinters and chips trying to get through the gap instead of continuing, under pressure, in the direction of the periphery of the grindstone under the blocking slab change directions in the said recess and because of this bump into the wall of the recess and are pressed against it, so that the advancing of the splinters and chips is stopped. It is essential that the depth and width of the recess are big enough, so that the splinter at least partly has room in the groove. As to known blocking slabs, where the retaining edge forms a smooth surface against the grindstone, the splinters and chips can unhindered glide under the blocking slab when they once have managed to get into a gap between the grindstone and the blocking slab.

It is preferable that the retaining edge of the blocking slab is stepped and forms at least two recesses separated by longitudinal ribs, so that a labyrinthlike obstacle, formed by alternately placed retaining ribs and recesses, is formed for the splinters and chips on the retaining edge.

The formation of recesses and retaining ribs on the retaining edge of the blocking slab increases the thickness of this part of the blocking slab and gives the possibility to get further support from this part to make the blocking slab stiffer against the bending caused by the load pressure. It is therefore preferable that on the retaining edge part of the blocking slab there is formed, besides the usual longitudinal fastening surface, another supporting surface, which is placed crosswise as regards the fastening surface, so that the blocking slab can be secured to the carrier of the grinder with a gusset. Thanks to this the blocking slab cannot bend or turn as regards the carrier, but retains its given position as regards the grindstone.

Figure 2:
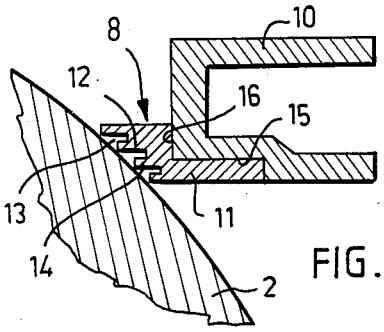
Figure 4:
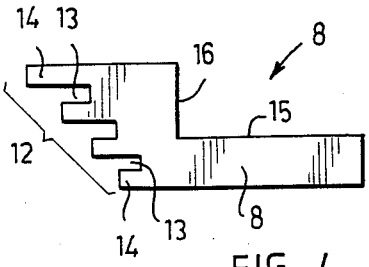
Figure 3:
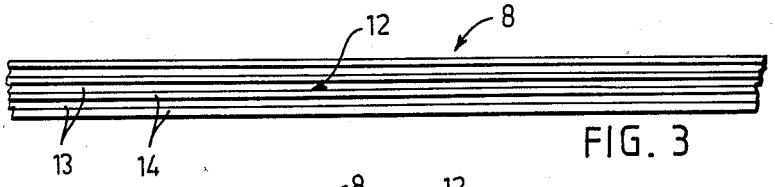
Figure 5:
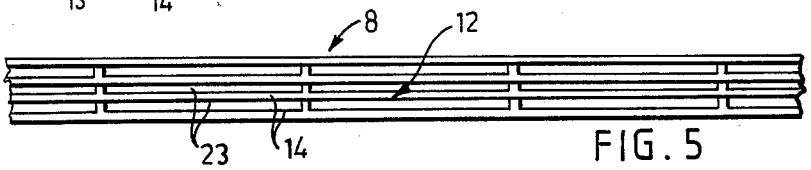

The invention is more closely explained in the following referring to the enclosed drawing, where FIG. 1 shows schematically a vertical section of the grinder provided with a blocking slab according to the invention, FIG. 2 shows, in a bigger scale, the blocking slab and the hereto joined carrier and peripherical part of the grindstone, FIG. 3 shows the blocking slab seen in the direction against the retaining edge, FIG. 4 shows, in an even bigger scale, a cross section of the blocking slab itself, and FIG. 5 shows an alternative embodiment of the blocking slab seen in the direction against the retaining edge.

The grinder shown in FIG. 1 of the drawing comprises a frame 1 and a grindstone 2 rotatingly mounted in the grinding chamber formed by the frame. On two sides of the stone there are grinding chambers 3 for the wood 4 to be ground, which is pressed against the grindstone by shoes 5 operated by pressure medium. Above both grinding chambers there is a feed pit 6 for the wood batches. Below the grindstone there is a tank 7, through which the ground pulp is fed from the grinder.

Both grinding chambers are provided with two blocking slabs 8 parallel with the axle of the grindstone, which close the gaps between the upper and corresponding lower wall 9 of the grinding chambers and the peripherical surface of the grindstone to prevent splinters and chips from getting out of the grinding chambers. Both blocking slabs are secured to the carrier 10 supporting the frame, which preferably is movable in order to adjust the space between the grindstone and the blocking slab to be as narrow as possible.

The blocking slab 8 comprises a striplike frame 11, which extends along the whole length of the grindstone and which has a retaining edge 12 turned against the grindstone. The retaining edge has three longitudinal recesses 13, which are situated between projecting longitudinal retaining ribs 14. The retaining ribs are stepped so that they all reach almost to the peripherical surface of the grindstone when the blocking slab is mounted to the carrier.

The frame of the blocking slab has a longitudinal fastening surface 15 and against the fastening surface a vertical supporting surface 16 for securing the blocking slab to the carrier, so that the blocking slab is supported against the carrier from two directions.

The recesses 13 of the blocking slab are formed like grooves which are open along the whole length of the frame, as shown in FIG. 3. The recesses can alternatively be formed by separate grooves placed longitudinally one after another, as shown in FIG. 5, reference number 23.

It is to be noticed that, thanks to the recesses on the retaining edge of the blocking slab, enlargements are formed in the space between the grindstone and the blocking slab, which enlargements are crosswise as regards the advancing direction of the splinters and chips. A splinter or chip that has got under the retaining edge changes its moving direction because of the enlargement and bumps into the wall of a recess. The blocking slab can thanks to the said stepped retaining edge function as a labyrinth packing and catch the splinters and chips that try to get out in the recesses of the retaining edge.

The splinters and chips trying to get through a gap between the blocking slab and the stone are usually less than 4 mm thick. For such splinters and chips the recesses of the blocking slab should be at least 4 mm wide and 5 mm deep and the whole width of the retaining edge should be at least 40 mm between the outermost retaining ribs.

Furthermore it is to be noticed that, thanks to the angle fastening formed by surfaces 15, 16, the blocking slab is firmly secured to the carrier to prevent the blocking slab from turning and bending.

The drawing and the hereto referring description are only meant to describe the basic idea of the invention. The blocking slab according to the invention can vary in its details within the frame of the patent claims.

I claim:

1. In a pulp grinder comprising a grindstone rotably mounted in a grinding chamber, means for pressing wood to be ground against the grindstone, and a blocking slab intended to prevent escape of unground splinters and chips from between the grindstone and a wall of the grinding chamber, the improvement comprising a blocking slab in the form of a striplike frame mounted between a wall of the grinding chamber and the grindstone, said frame being parallel to the axle of said grindstone and having a longitudinal retaining edge facing the peripheral surface of said grindstone, said retaining edge being provided with at least one recess located between two longitudinal retaining ribs, said recess being substantially parallel with the axle of the pulpstone and extending the length of the pulpstone wherein said recess is formed as a groove open along the whole length of the frame.

2. A blocking slab according to claim 1, wherein said retaining edge is stepped and forms several alternately placed recesses and retaining ribs.

3. A blocking slab according to claim 1, the frame of which blocking slab has a longitudinal fastening surface, said retaining edge part being provided with a longitudinal supporting surface, which constitutes an angle, preferably an angle of 90°, with said fastening surface.

4. In a pulp grinder comprising a grindstone rotably mounted in a grinding chamber, means for pressing wood to be ground against the grindstone, and a blocking slab intended to prevent escape of unground splinters and chips from between the grindstone and a wall of the grinding chamber, the improvement comprising a blocking slab in the form of a striplike frame mounted between a wall of the grinding chamber and the grindstone, said frame being parallel to the axle of said grindstone and having a longitudinal retaining edge facing the peripheral surface of said grindstone, said retaining edge being provided with a plurality of longitudinal recesses located between longitudinal retaining ribs, said recesses being substantially parallel with the axle of the pulpstone and extending the length of the pulpstone each of said recesses being formed by separate grooves placed longitudinally one after another.

* * * * *